US009863132B2

(12) United States Patent
Shiraishi et al.

(10) Patent No.: US 9,863,132 B2
(45) Date of Patent: Jan. 9, 2018

(54) FLUSH TOILET APPARATUS

(71) Applicant: TOTO LTD., Fukuoka (JP)

(72) Inventors: Masateru Shiraishi, Kitakyushu (JP); Mitsuo Koga, Kitakyushu (JP); Satoshi Yamazaki, Kitakyushu (JP); Kohei Tsuji, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/057,808

(22) Filed: Mar. 1, 2016

(65) Prior Publication Data

US 2016/0258151 A1 Sep. 8, 2016

(30) Foreign Application Priority Data

Mar. 6, 2015 (JP) ..... 2015-044351
Mar. 6, 2015 (JP) ..... 2015-045108

(51) Int. Cl.
*E03D 9/08* (2006.01)

(52) U.S. Cl.
CPC ..... *E03D 9/08* (2013.01)

(58) Field of Classification Search
CPC ..... E03D 9/08
See application file for complete search history.

(56) References Cited

U.S. PATENT DOCUMENTS 3,781,919 A * 1/1974 Ayala ..... E03D 9/08 4/236
2008/0222784 A1* 9/2008 Ware ..... E03D 3/02 4/420.5

FOREIGN PATENT DOCUMENTS

DE 202013001133 U1 3/2014
JP 2009-285169 A 12/2009
JP 2014-147445 A 8/2014

OTHER PUBLICATIONS

The extended European search report issued by the European Patent Office dated Aug. 19, 2016, which corresponds a European Patent Application No. 16158112.9-1608 and is related to U.S. Appl. No. 15/057,808.

* cited by examiner

*Primary Examiner* — Janie Loeppke
(74) *Attorney, Agent, or Firm* — Studebaker & Brackett PC

(57) ABSTRACT

A flush toilet apparatus includes a hole wherein a tubular member is connected to a connecting portion disposed on the outside of a flush toilet apparatus through a hole portion formed at the rear top surface of a flush toilet main body, and the hole portion comprises a hole penetrating the entire wall thickness of the flush toilet main body; and an guiding path disposed adjacent to the hole, for guiding the tubular member to the hole; wherein at least a portion of the hole of the hole portion is covered by an affixing member, and the tubular member is inserted into the hole through the gap formed between the affixing member and the guiding path.

11 Claims, 8 Drawing Sheets

FLUSH TOILET APPARATUS

BACKGROUND OF THE INVENTION

1. Technical Field

The present invention pertains to a flush toilet apparatus, and more particularly to a flush toilet apparatus in which part of a tubular member is housed inside the flush toilet main body.

2. Description of Related Art

For some time, as described for example in Patent Document 1 (Japanese Patent Unexamined Publication No. 2014-147445), flush toilet apparatuses have been known in which a washing apparatus (sanitary washing apparatus) housing a functional portion for anal area washing is affixed relative to an affixing member affixed at the rear top surface of the flush toilet main body.

In such flush toilet apparatuses, when tubular members such as water supply pipes or power supply cords connected to a washing apparatus are in turn connected to water supply connections or power supply connection on a wall, the tubular members such as supply pipes or power supply cords are housed inside the flush toilet main body.

Patent Document 1 sets forth a flush toilet in which a hole is formed close to one end in the longitudinal direction of an affixing member affixed at the rear of the top surface of a flush toilet main body, and supply pipes and power supply cords and the like pass through this hole and are extended from the rear surface of the flush toilet main body, so that except for the end portions, supply pipes and power supply cords, etc. are concealed inside the flush toilet main body and visual appearance is improved.

BRIEF SUMMARY OF THE INVENTION

However, in the flush toilet apparatus described above, the high rigidity of the supply pipe means restricts routing of the supply pipe, making it difficult to insert supply pipes and power supply cords through the hole.

Also, in recent years there has been a growing demand for more compact flush toilet apparatuses in order to improve design characteristics, and for reductions in the size of each part of the flush toilet apparatus.

Therefore as the compactifying of flush toilet apparatuses proceeds, the problem has arisen that forming a hole in a position not overlapping with an affixing member has become difficult.

The present invention was therefore undertaken to solve the above-described problems with the conventional art, and has the object of providing a flush toilet apparatus with which tubular members can be easily inserted into the flush toilet main body when attaching and detaching a washing apparatus, even if the affixing member and a part of the hole overlap due to compactification.

In order to accomplish the above-described object, the present invention is a flush toilet apparatus comprising: a flush toilet main body; an affixing member affixed on a rear top surface of the flush toilet main body; and a washing apparatus attached to the affixing member, the washing apparatus having at least one tubular member including a proximal end portion and a distal end portion, wherein the proximal end portion of the at least one tubular member is connected to the washing machine and the distal end portion of the at least one tubular member is connected to a connecting portion disposed on the outside of the flush toilet apparatus via a hole portion formed on the rear top surface of the flush toilet main body, and the hole portion comprises a hole penetrating the entire wall thickness of the flush toilet main body, and a guiding path disposed adjacent to the hole, and wherein at least part of the hole of the hole portion is covered by the affixing member.

Further, in the present invention the at least one tubular member is disposed into the hole through a gap formed between the affixing member and the guiding path.

According to the inventions thus constituted, at least a part of the hole in the hole portion is covered by the affixing member, therefore compared to the case in which a part of the hole portion is not concealed by the affixing member, the length in the flush toilet main body width direction (the same direction as the longitudinal direction of the affixing member) or the length in the depth direction (the same direction as the short direction of the affixing member) is shortened, enabling the flush toilet main body to made compact, and the flush toilet apparatus as a whole to be made compact.

Also, the hole portion includes the hole penetrating the entire wall thickness of the flush toilet main body and a guiding path disposed adjacent to the hole; by being inserted into the hole through the gap formed between the affixing member and the guiding path, the tubular member not only becomes the guide when the guiding path inserts the tubular member into the hole, but is also able to insert the tubular member into the hole from the guiding path even when at least a part of the hole portion is covered by an affixing member, therefore the tubular member can be conveniently inserted into the flush toilet main body when the washing apparatus is being installed or detached to/from the flush toilet main body, even in a reduced size flush toilet apparatus of the type in which the affixing member and a portion of the hole overlap.

In the present invention, preferably, the guiding path of the hole portion is disposed further inside longitudinal end portions of the affixing member.

According to the invention thus constituted, the fact that the guiding path of the hole portion is disposed further inside the end portions of the affixing member means that, compared to the case when the guiding path of the hole portion is outside the end portion in the longitudinal direction of the affixing member, the length of the flush toilet main body in the width direction is shorter, so the flush toilet main body can be made compact, and the flush toilet apparatus as a whole can be made compact.

In the present invention, preferably, the proximal end portion of the at least one tubular member is disposed adjacent to one longitudinal end portion of the affixing member, and the hole of the hole portion is disposed adjacent to the other longitudinal end portion of the affixing member.

According to the invention thus constituted, the base end portion of the tubular member is disposed adjacent to one longitudinal end portion of the affixing member, and the hole of the hole portion is disposed adjacent to the other longitudinal end portion of the affixing member, so a long distance between the tubular member proximal end portion and the hole can be secured in the longitudinal direction of the affixing member, thereby effectively preventing bending of the tubular member.

In the invention, preferably, the proximal end portion of the at least one tubular member and the hole portion of the flush toilet main body are disposed on the same side with respect to the longitudinal central cross-section of the flush toilet main body.

According to the invention thus constituted, because the proximal end portion of the at least one tubular member and the hole portion of the flush toilet main body are disposed on the same side with respect to the longitudinal central cross section of the flush toilet main body, the exposed length of the tubular member is shortened so that exposure of the tubular member can be constrained.

In the present invention, preferably, the at least one tubular member is either a water supply pipe, or an electrical cable.

According to the invention thus constituted, a drop in the amount of flush water supplied to the washing apparatus due to bends in the supply pipe is prevented even if the tubular member is a water supply pipe supplying flush water to the washing apparatus, therefore a diminution of the anal area washing functionality of the washing apparatus can be prevented.

Also, even if the tubular member is an electrical cable supplying power to the washing apparatus, wire breaks caused by bending of the electrical cable can be prevented, hence a loss of washing apparatus functionality can be prevented.

In the present invention, preferably, the washing apparatus is removably secured on the flush toilet main body by slide operation of the washing apparatus in the front-back direction, the hole portion is disposed on the rear side of the top surface of the flush toilet main body, and wherein the proximal end portion of the at least one tubular member is disposed on one side with respect to the longitudinal central cross-section of the flush toilet main body, and the hole portion is disposed on the other side with respect to the longitudinal central cross-section of the flush toilet main body.

According to the invention thus constituted, when the washing apparatus is slid rearward and affixed to an affixing member attached to the rear top surface of the flush toilet main body, the base end portion of the tubular member connected to the rear side of the washing apparatus is disposed on one side of the center axis line in the left-right direction extending in the front-back direction, and the hole portion passing the tubular member through is disposed on the other side of the center axis line, therefore the tubular member proximal end portion and the hole portion separate along the left-right direction and the distance between them lengthens, with the result that no excessive external force acts on the tubular member, and bending of the tubular member can be prevented.

In the present invention, preferably, the guiding path of the hole portion is disposed backward of the affixing member in the front-back direction of the flush toilet apparatus.

According to the invention thus constituted, the guiding path of the hole portion is disposed backward of the affixing member in the front-back direction of the flush toilet apparatus, therefore the flush toilet apparatus can be made smaller in the width dimension, and space reduction can be achieved.

In the present invention, preferably, the at least one tubular member proximal end portion and hole portion are disposed adjacent to the respective end portions of the affixing member.

According to the invention thus constituted, the tubular member proximal end portion and hole portion are respectively disposed adjacent to the respective end portions of the affixing member, therefore the distance between the tubular member proximal end portion and the hole portion in the left-right direction lengthens, so that bending of the tubular member can be more effectively prevented when the washing apparatus is slid rearward.

In the present invention, preferably, the at least one tubular member is a water supply pipe.

According to the invention thus constituted, when the tubular member is a water supply pipe, flush water is more difficult to supply to the washing apparatus when the water supply pipe is bent, causing anal area washing functionality to drop, but such drops in anal area washing functionality can be prevented.

In the present invention, preferably, the least one tubular member comprises a plurality of tubular members, the tubular members being a water supply pipe, and an electrical cable.

According to the invention thus constituted, when the tubular member is a water supply pipe, flush water is more difficult to supply to the washing apparatus when the water supply pipe is bent, causing the anal area washing functionality to drop, but such drops in anal area washing functionality can be prevented, and when the tubular member is an electrical cable, wire breaks can occur when the electrical cable bends, but these wire breaks can also be prevented.

In the present invention, preferably, the guiding path of the hole portion has an indentation a bottom of which is downward sloped toward the hole.

According to the invention thus constituted, a downward sloping indentation is formed in the guiding path of the hole portion, therefore the hole portion guide portion can easily guide the tubular member and pass it through the hole.

Using the flush toilet apparatus of the present invention a tubular member can be easily inserted into the flush toilet main body when installing or removing a washing apparatus to/from the flush toilet main body, even if the affixing member and a part of the hole overlap due to reductions in size.

DETAILED DESCRIPTION OF THE INVENTION

Below, referring to the attached drawings, we explain a flush toilet apparatus according to a first embodiment of the invention.

Figure 1:
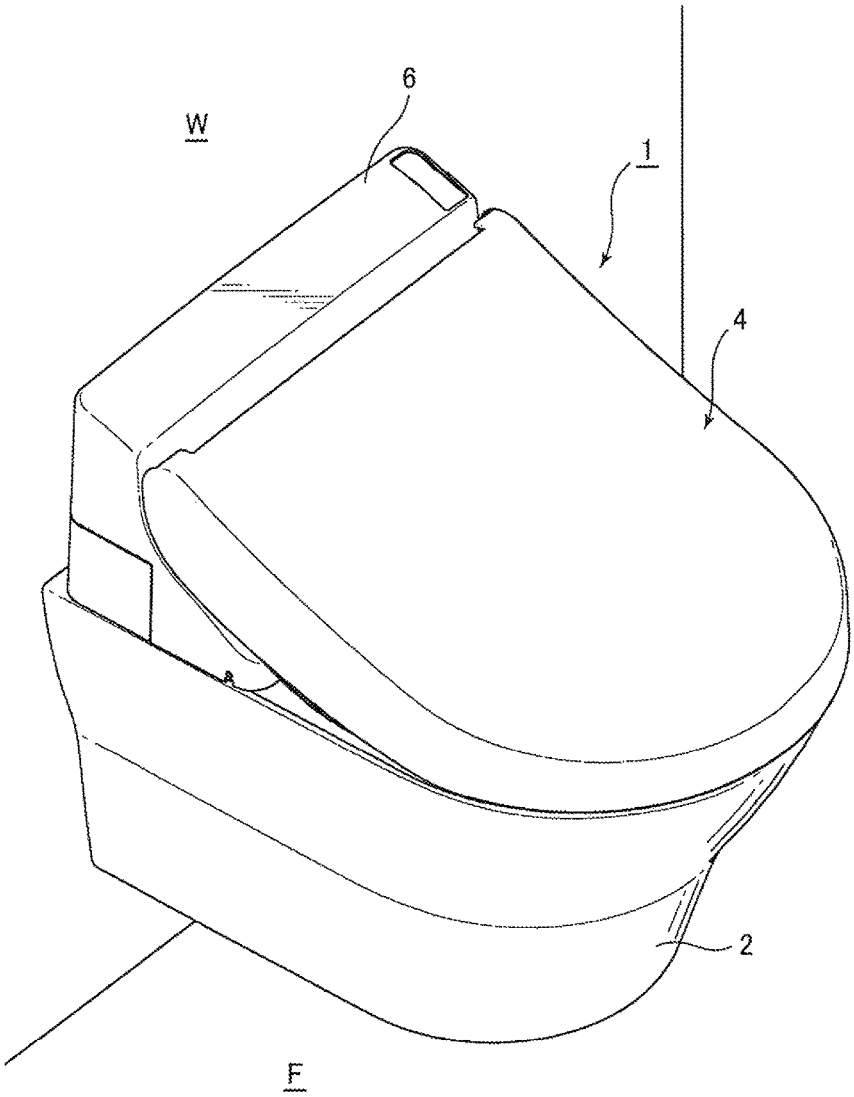
FIG. 1 is a perspective view showing a flush toilet apparatus according to a first embodiment of the invention.
Figure 2:
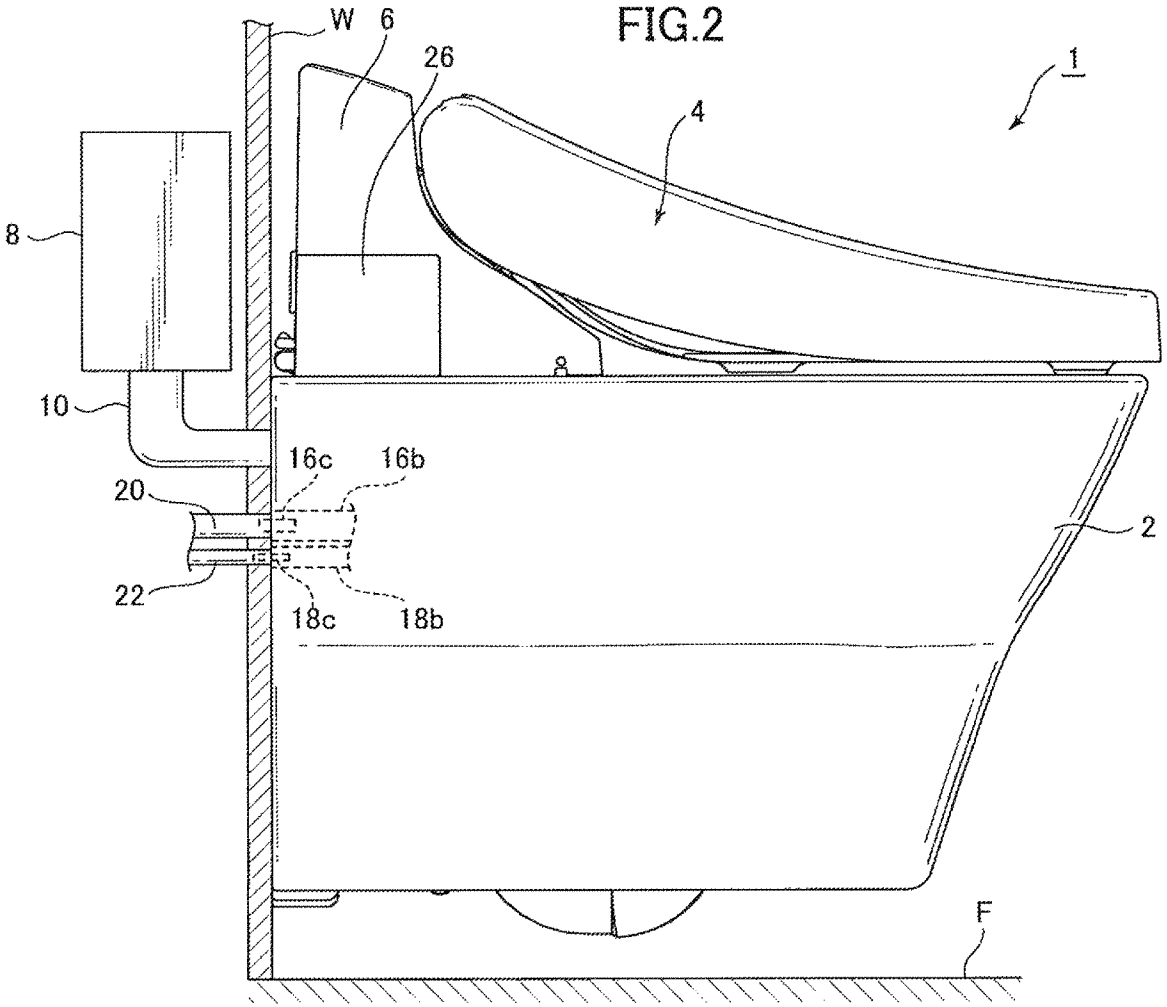
FIG. 2 is a side view showing a flush toilet apparatus according to a first embodiment of the invention.

First, referring to FIGS. 1 and 2, we explain the basic structure of a flush toilet apparatus according to the present embodiment.

FIG. 1 is a perspective view showing a flush toilet apparatus according to a first embodiment of the invention; FIG. 2 is a side view showing a flush toilet apparatus according to a first embodiment of the invention.

As shown in FIG. 1, a flush toilet apparatus 1 includes a toilet main body 2 and a washing apparatus 4 attached to this toilet main body 2.

The toilet main body 2 includes a bowl portion 2*a*; the bowl portion 2*a* is flushed with flush water so that waste is discharged.

In addition, the washing apparatus 4 has a functional portion 6 comprising a flush nozzle (not shown), a nozzle drive motor (not shown), a motor control device (not shown), and the like; a user's anal area is washed by anal area-washing flush water spouted from a flush nozzle.

The flush toilet apparatus 1 is mounted on a wall surface W and is separated from the floor F. A storage tank 8 for storing flush water is disposed on the inner side of the wall surface W; flush water passes through water supply plumbing 10 connected to this storage tank 8 and is supplied to the toilet main body 2 in the flush toilet apparatus 1.

Next, referring to FIGS. 3 through 7, we explain the detailed structure of a flush toilet apparatus according to an embodiment of the invention.

Figure 3:
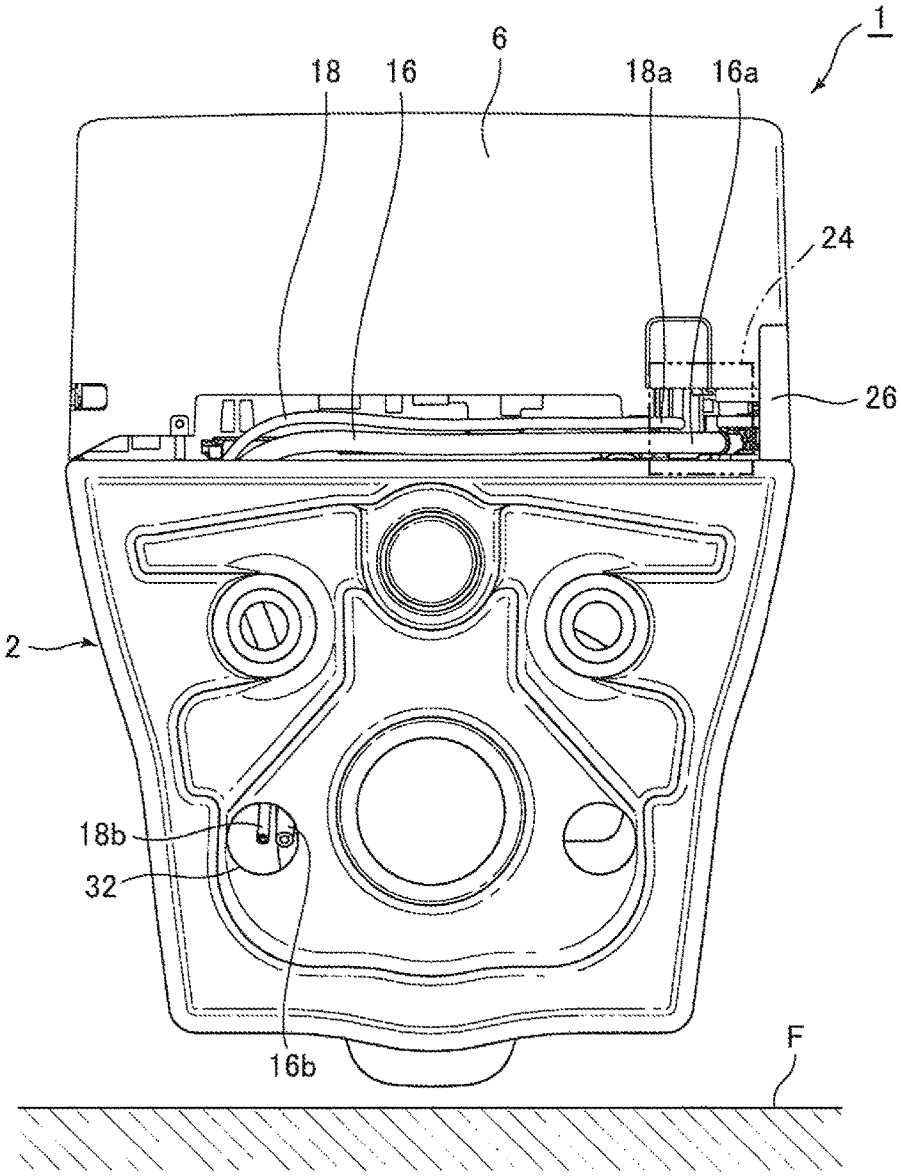
FIG. 3 is a rear view showing a flush toilet apparatus according to a first embodiment of the invention.
Figure 4:
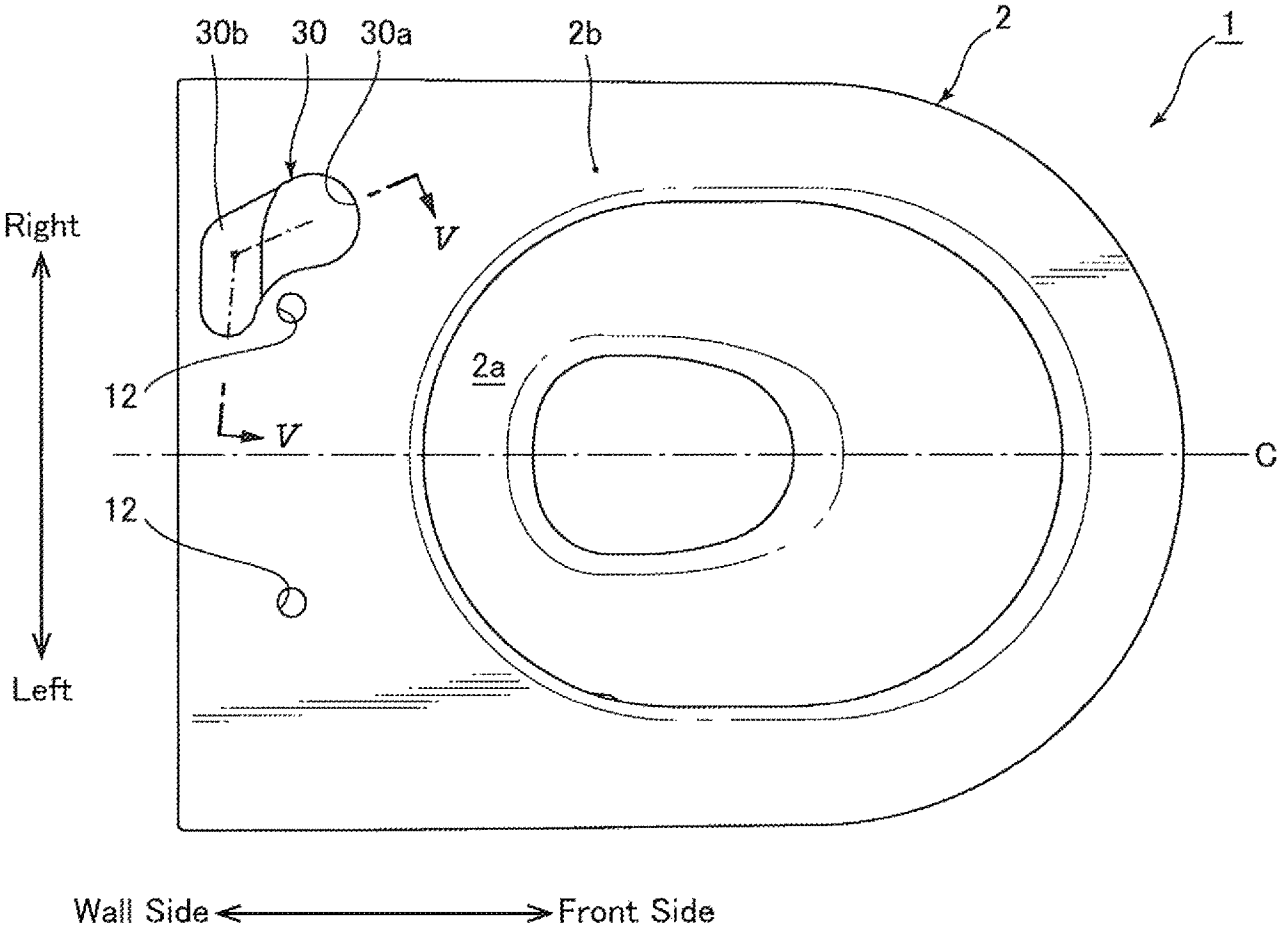
FIG. 4 is a plan view of a flush toilet main body in a flush toilet apparatus according to a first embodiment of the invention.
Figure 5:
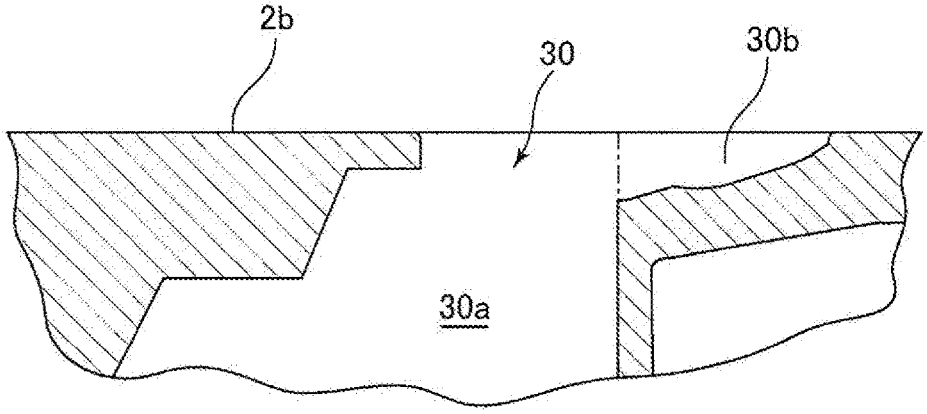
FIG. 5 is a partial cross section of a flush toilet main body seen along line V-V in FIG. 4.
Figure 6:
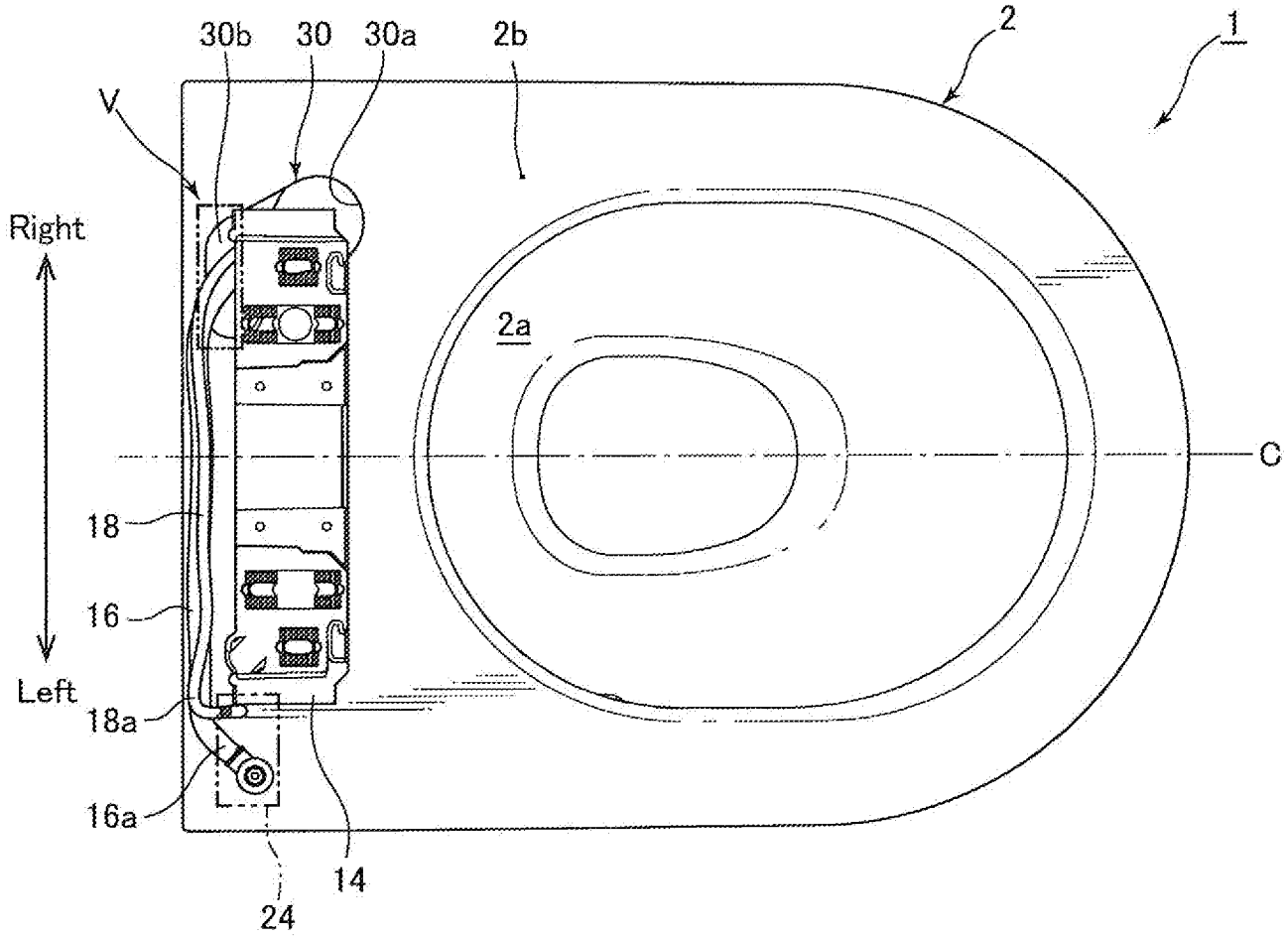
FIG. 6 is a plan view showing the positional relationship between a flush toilet main body, a tubular member, and an affixing member, with the washing apparatus attached to the flush toilet main body in the flush toilet apparatus of the first embodiment of the invention; a depiction of the washing apparatus is omitted.

FIG. 3 is a rear view showing a flush toilet apparatus according to the first embodiment of the invention; FIG. 4 is a plan view showing a flush toilet main body according to a first embodiment of the invention. FIG. 5 is a partial cross section of a flush toilet main body seen along line V-V in FIG. 4; FIG. 6 is a plan view showing the positional relationship between a flush toilet main body, a tubular member, and an affixing member, with the washing apparatus attached to the flush toilet main body in the flush toilet apparatus of the first embodiment of the invention; a depiction of the washing apparatus is omitted. Furthermore, FIG. 7 is a perspective view showing the state prior to attaching a washing apparatus to an affixing member on the flush toilet apparatus of the first embodiment of the invention.

First, as shown in FIG. 4, two attaching holes 12 are formed on the rear top surface of the toilet main body 2.

Figure 7:
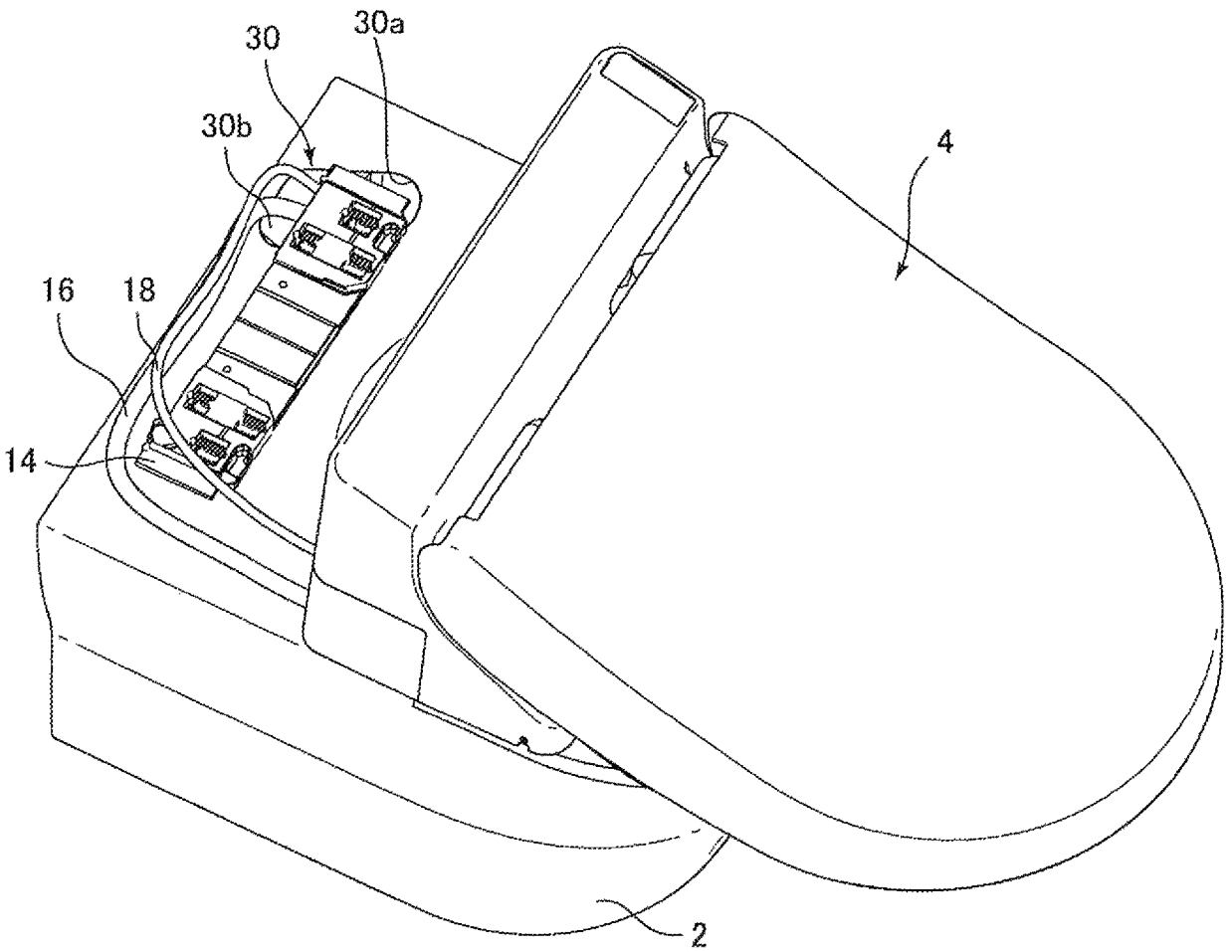
FIG. 7 is a perspective view showing the condition prior to attaching the washing apparatus to an affixing member on the flush toilet apparatus of the first embodiment of the invention.

Also, as shown in FIGS. 4, 6, and 7, a rectangular affixing member 14 extending in the left-right direction (width direction) is attached to the attaching holes 12 by bolts or the like.

The washing apparatus 4 is affixed to the affixing member 14, and is attached to the toilet main body 2.

Details are discussed below, but the washing apparatus 4 can be slid rearward and affixed to the affixing member 14, attaching to the toilet main body 2, or the washing apparatus 4 can be slid forward, removed from the affixing member 14, and detached from the toilet main body 2.

Next, as shown in FIGS. 2 and 3, base end portions 16*a*, 18*a* of the water supply pipe 16 and the electrical cable 18, which are tubular members, are respectively connected at the rear left side of the washing apparatus 4. Connecting hardware 16*c* is attached to the tip portion 16*b* of these water supply pipes 16, and a plug 18*c* is attached to the tip portion 18*b* of the electrical cable 18.

Also, as shown in FIG. 2, this connecting hardware 16*c* and plug 18*c* are respectively connected to the water supply pipe connecting portion 20 and electrical cable connecting portion 22, which are connecting portions disposed on the wall surface W, which is external to the flush toilet apparatus 1.

Moreover, as shown in FIGS. 2 and 3, the rear left side of the washing apparatus 4 to which the water supply pipe 16 base end portion 16 and electrical cable 18 base end portion 18*a* are respectively connected becomes an exposed portion 24, but this exposed portion 24 is concealed by a concealing panel 26.

Next, as shown in FIG. 4, on the top surface 2*b* of the toilet main body 2 at the rear right side of the toilet main body 2 bowl portion 2*a*, a hole portion 30 is provided to pass the above-described water supply pipe 16 and electrical cable 18 from above to below. The hole portion 30 includes a hole 30*a* connecting the toilet main body 2 top surface and interior, and an guiding path 30*b* as an entry portion communicating with the hole 30*a* and guiding the water supply pipe 16 and the electrical cable 18 to the hole 30*a*; viewed in plan view, the hole portion 30 has a curved shape from the guiding path 30*b* to the hole 30*a*.

As shown in FIGS. 5 through 7, the hole 30*a* of the hole portion 30 is shaped so that its cross section expands in the direction in which the water supply pipe 16 and the electrical cable 18 extend, as well as downward.

Additionally, as shown in FIGS. 5 through 7, the guiding path 30*b* of the hole portion 30 is disposed further inward than the longitudinal direction end portion of the affixing member 14, and slopes downward toward the right outer side when the toilet main body 2 is viewed from the front, so that it is disposed further back than the affixing member 14.

As shown in FIG. 6, the affixing member 14 attached to the rear of the top surface 2*b* of the toilet main body 2 covers the hole portion 30 hole 30*a* and a portion of the guiding path 30*b*. The guiding path 30*b* of the hole portion 30 is disposed behind the affixing member 14 as described above, and a space region V of a sufficient size for insertion of the water supply pipe 16 and the electrical cable 18 is secured.

I.e., a space region V, which is a gap sufficiently open for the water supply pipe 16 and electrical cable 18 to be inserted, is formed between the affixing member 14 and the guiding path 30*b*, and the water supply pipe 16 and electrical cable 18 are inserted into this space region V.

In addition, as shown in FIG. 6, each of the base end portions 16*a*, 18*a* on the water supply pipe 16 and electrical cable 18, and the hole portion 30, are respectively disposed adjacent to the two end portions in the left-right direction of the affixing member 14.

A left-right direction center axis line C extending in the front-back direction of the flush toilet apparatus 1 is shown in FIG. 6. The respective base end portions 16*a*, 18*a* on the water supply pipe 16 and electrical cable 18 connected to the washing apparatus 4, and the hole portion 30, sandwich this center axis line C and are respectively positioned on the left-right direction end portions at the rear of the toilet main body 2.

I.e., each of the base end portions 16*a*, 18*a* on the water supply pipe 16 and electrical cable 18 are disposed adjacent to one end in the longitudinal direction of the affixing member 14 (the left end), and the hole 30*a* of the hole portion 30 is disposed adjacent to the other end in the longitudinal direction of the affixing member 14 (the right end); the water supply pipe 16 and electrical cable 18 base end portions 16*a*, 18*a* and the hole portion 30 are separated along the left-right direction so that a long distance can be secured between the two.

Note that in the present embodiment each of the water supply pipe 16 and electrical cable 18 base end portions 16*a*, 18*a* is positioned on the left side of the toilet main body 2 relative to the center axis line C, and the hole portion 30 is positioned on the right side of the center axis line C, but it is sufficient for the two to be disposed so as to sandwich the center axis line C, or the two may be disposed at the reverse positions in the left-right direction.

For both the water supply pipe 16 and electrical cable 18 base end portions 16*a*, 18*a* and the hole portion 30, it is also acceptable to constrain the exposure of the water supply pipe 16 and electrical cable 18 by setting the exposure length of the water supply pipe 16 and electrical cable 18 to be still shorter, by placing them on one side or the other in the width direction of the toilet main body 2 relative to the center axis line C.

Also, after the water supply pipe 16 and electrical cable 18 pass through the interior of the toilet main body 2 through the guiding path 30*b* and hole 30*a* on the hole portion 30 on the top surface 2*b* of the toilet main body 2, the water supply pipe 16 tip portion 16*b* and the electrical cable 18 tip portion 18*b* are extending to the outside of the toilet main body 2 from the take-off hole 32 (see FIG. 3) formed on the rear surface of the toilet main body 2.

Next we explain an operation for mounting the washing apparatus 4 of the flush toilet apparatus 1 to the toilet main body 2 in a first embodiment of the invention.

First, the tip portion 16*b* of the water supply pipe 16 to which the connecting hardware 16*c* is attached, and the tip portion 18*b* of the electrical cable 18 to which the plug 18*c* is attached, are inserted from the guiding path 30*b* on the hole portion 30.

This is because the water supply pipe 16 connecting hardware 16*c* and the electrical cable 18 plug 18*c* are larger than the diameters of the water supply pipe 16 and the electrical cable 18, so it is necessary to insert into the hole portion 30 before the affixing member 14 blocks a portion of the hole portion 30.

As shown in FIGS. 4 and 7, the affixing member 14 is the attached to the attaching holes 12 in the toilet main body 2.

Next, with the water supply pipe 16 and electrical cable 18 inserted into the hole portion 30, the washing apparatus 4 is slid rearward and affixed to the affixing member 14 to be attached to the toilet main body 2.

When sliding this washing apparatus 4 rearward, the base end portions 16*a*, 18*a* of the water supply pipe 16 and electrical cable 18 separate along the left-right direction from the hole portion 30, and the distance between them lengthens so that they are able to extend in a large arc shape toward the hole portion 30 from the left end portion of the washing apparatus 4, such that excessive force does not act on the water supply pipe 16 and electrical cable 18, and major bending can be prevented.

When the washing apparatus 4 is slid rearward, the water supply pipe 16 and electrical cable 18 are able to move toward the hole 30*a* while being guided by the downward sloping indented face of the guiding path 30*b* on the hole portion 30; in addition, the hole 30*a* is expanded in both the direction in which the water supply pipe 16 and electrical cable 18 extend and the downward direction, and can therefore be easily passed through the guiding path 30*b*; moreover, no excessive external force acts on the water supply pipe 16 and electrical cable 18, which further prevents major bending.

Note that when removing the washing apparatus 4 from the toilet main body 2, it is sufficient to slide the washing apparatus 4 forward.

In a flush toilet apparatus 1 according to the present embodiment we explained the form in which the washing apparatus 4 is attached to the toilet main body 2 by sliding the washing apparatus 4 rearward relative to the affixing member 14 and affixing it to the affixing member 14, but the invention may also take the form of mounting the washing apparatus 4 on the affixing member 14.

In a flush toilet apparatus 1 according to the above-described first embodiment, because the length in the width direction (the same direction as the longitudinal direction of the affixing member 14) or the depth direction (the same direction as the longitudinal direction of the affixing member 14) is shortened by the covering of at least a portion of the hole 30*a* of the hole portion 30 by the affixing member 14, the size of the toilet main body 2, and the size of the entire flush toilet apparatus 1, can be further reduced compared to the case in which a portion of the hole portion 30 is not concealed by the affixing member 14.

The hole portion 30 has a hole 30*a* connecting the top surface and the interior of the flush toilet main body 2, and an guiding path 30*b* disposed adjacent to this hole 30*a* and guiding the water supply pipe 16 and electrical cable 18 to the hole 30*a*; by inserting the water supply pipe 16 and electrical cable 18 into the hole 30*a* through the gap formed between the affixing member 14 and the guiding path 30*b*, not only does the guiding path 30*b* become the guide when the water supply pipe 16 and electrical cable 18 are inserted into the hole 30*a*, but the water supply pipe 16 and electrical cable 18 can be inserted into the hole 30*a* from the guiding path 30*b* even if at least a portion of the hole portion 30 is covered by the affixing member 14, therefore even in a size-reduced flush toilet apparatus in which the affixing member and a portion of the hole overlap, the water supply pipe 16 and electrical cable 18 can be conveniently inserted into the toilet main body 2 when attaching or removing the washing apparatus 4 to/from the toilet main body 2.

Using the flush toilet apparatus 1 of the present embodiment, because the guiding path 30*b* of the hole portion 30 is positioned further to the inside than the end portion in the longitudinal direction of the affixing member 14, the length in the width direction of the toilet main body 2 is shorter compared to the case when the guiding path 30*b* of the hole portion 30 is further outside the end portion in the longitudinal direction of the affixing member 14, therefore the size of the toilet main body 2 can be reduced, and the size of the entire flush toilet apparatus 1 can be reduced.

Moreover, using the flush toilet apparatus 1 of the present embodiment, as shown in FIG. 6, each of the base end portions 16*a*, 18*a* on the water supply pipe 16 and the electrical cable 18 are disposed adjacent to the left side end portion, which is one end in the longitudinal direction of the affixing member 14, and the hole 30*a* of the hole portion 30 is disposed adjacent to the right side end portion, which is the other end in the longitudinal direction of the affixing member 14, hence a long distance from each of the base end portions 16*a*, 18*a* on the water supply pipe 16 and the electrical cable 18 to the hole 30*a* of the hole portion 30 can be secured in the affixing member 14 longitudinal direction, so that bending of the tubular member can be effectively prevented.

Moreover, by using the flush toilet apparatus 1 of the present embodiment, the amount of flush water being supplied to the washing apparatus 4 is prevented from dropping due to bends in the water supply pipe 16 even if the tubular member connected to the washing apparatus 4 is the water supply pipe 16 supplying flush water to the washing apparatus 4, therefore a drop in the anal area washing functionality of the washing apparatus 4 can be prevented.

Also, even if the tubular member is an electrical cable 18 supplying power to the washing apparatus 4, wire breaks caused by bending of the electrical cable 18 can be prevented, hence a loss of washing apparatus 4 functionality can be prevented.

In addition, using the flush toilet apparatus 1 of the present embodiment, the washing apparatus 4 is slid rearward and affixed to the affixing member 14 attached at the rear top surface of the toilet main body 2, the base end portions 16*a*, 18*a* on the water supply pipe 16 and electrical cable 18 connected at the rear side of the washing apparatus 4 is disposed on the left side of the left-right direction center axis line C extending in the front-back direction of the flush toilet apparatus 1, and the hole portion 30 is disposed on the right side of the center axis line C; therefore the base end portions 16*a*, 18*a* on the water supply pipe 16 and electrical cable 18, and the hole portion 30, are separated along the left-right direction such that the distance between them is lengthened, with the result that no excessive external force acts on the water supply pipe 16 and the electrical cable 18, and bending of tubular members can be prevented. Specifically, when the water supply pipe 16 bends, flush water becomes difficult to supply to the washing apparatus 4, and anal area washing functionality drops, but this type of anal area washing functionality loss can be prevented, and although wire breaks can occur when the electrical cable 18 bends, these wire breaks can also be prevented.

Also, using the flush toilet apparatus 1 of the present embodiment, the guiding path 30*b* of the hole portion 30 is positioned further to the rear than the affixing member 14, therefore the dimension in the width direction of the flush toilet apparatus 1 can be reduced, and a reduction in space can be achieved.

In addition, by using the flush toilet apparatus 1 of the present embodiment, the base end portions 16*a*, 18*a* of the water supply pipe 16 and electrical cable 18 and the hole portion 30 are respectively disposed adjacent to the left and right end portions of the affixing member 14 so that the distance between the base end portions 16*a*, 18*a* of the water supply pipe 16 and electrical cable 18 and the hole portion 30 lengthens, such that bending of the water supply pipe 16 and the electrical cable 18 when the washing apparatus 4 is slid rearward can be more effectively prevented.

Furthermore, by using the flush toilet apparatus 1 of the present embodiment, when the tubular member connected to the washing apparatus 4 is a water supply pipe 16, flush water becomes difficult to supply to the washing apparatus 4 when the water supply pipe 16 bends, and anal area washing functionality diminishes, but this type of drop in anal area washing functionality can be prevented.

Also, wire breaks can occur when the electrical cable 18 bends in cases when the tubular member connected to the washing apparatus 4 is an electrical cable 18, but such wire breakage can also be prevented.

Also, by using the flush toilet apparatus 1 of the present embodiment, a downward sloping indentation is formed on the guiding path 30*b* of the hole portion 30, therefore the guiding path 30*b* can guide the water supply pipe 16 and electrical cable 18 and easily pass it into the hole 30*a* on the hole portion 30.

Figure 8:
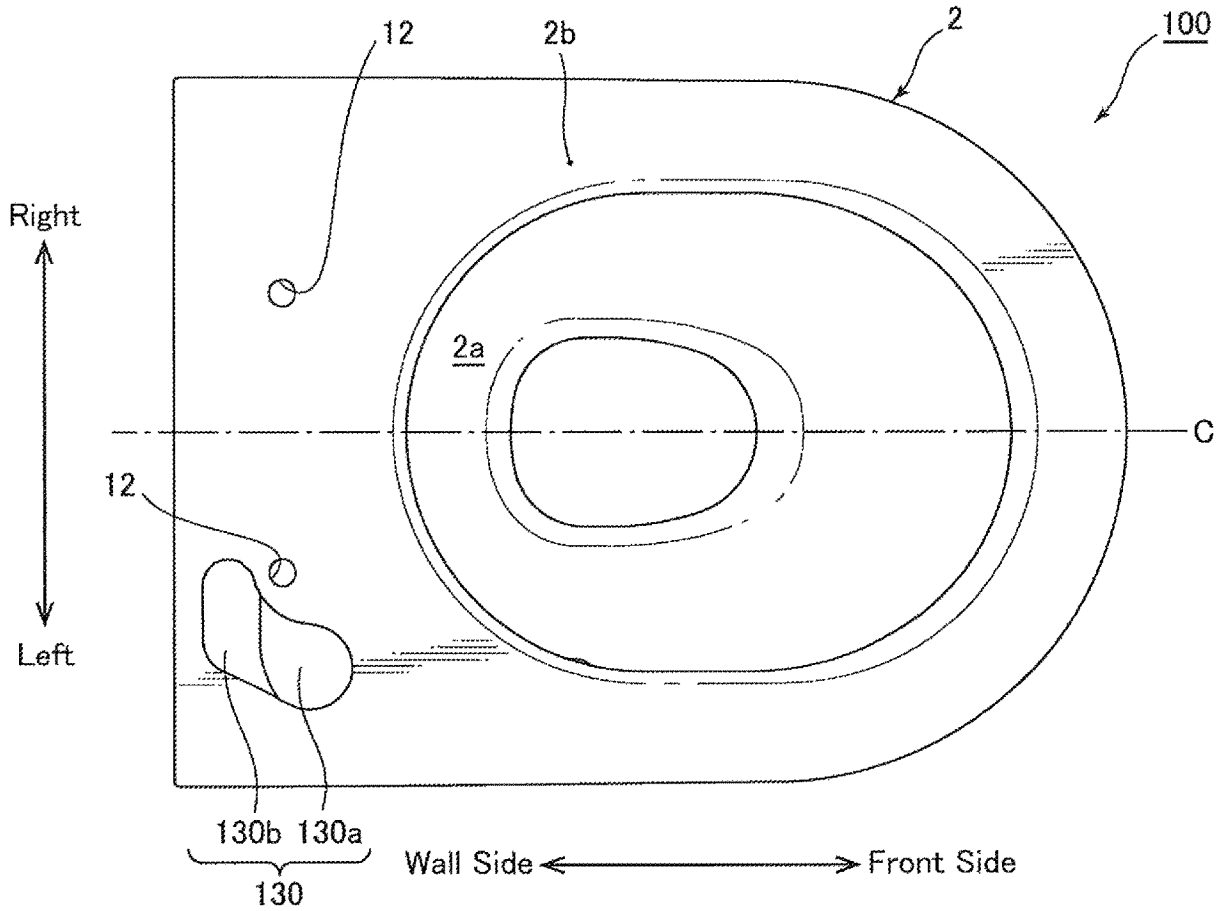
FIG. 8 is a perspective view of a flush toilet main body in a flush toilet apparatus according to a second embodiment of the invention.

Next, referring to FIG. 8, we explain a flush toilet apparatus according to a second embodiment of the invention.

FIG. 8 is a plan view of a flush toilet main body in a flush toilet apparatus according to a second embodiment of the invention.

Note that in a flush toilet 100 according to the embodiment of the invention shown in FIG. 8, those parts which are the same as parts of the flush toilet apparatus 1 according to the first embodiment shown in FIGS. 1 through 7 are assigned the same reference numerals, and an explanation thereof is here omitted.

As shown in FIG. 8, in a flush toilet apparatus 1 according to a second embodiment of the invention the hole portion 130 for passing the water supply pipe 16 and electrical cable 18 connected to the washing apparatus 4 from the upper part of the toilet main body 2 through the interior of the toilet main body 2 is positioned further to the rear than the bowl portion 2*a* on the toilet main body 2, and is disposed to the left side of the center axis line C.

I.e., the hole portion 130 on the toilet main body 2, together with each of the base end portions 16*a*, 18*a* of the water supply pipe 16 and electrical cable 18, is positioned on the left side in the width direction of the toilet main body 2 relative to the center axis line C in the left-right direction extending in the front-back direction of the flush toilet apparatus 1.

Note that the hole portion 130 on the toilet main body 2, together with each of the base end portions 16*a*, 18*a* of the water supply pipe 16 and electrical cable 18, may also be positioned on the right side in the width direction of the toilet main body 2 relative to the center axis line C in the left-right direction extending in the front-back direction of the flush toilet apparatus 1.

The hole portion 130 is formed on the top surface 210*a* of the toilet main body 2, and has a hole 130*a* penetrating the top surface 210*a* of the toilet main body 2 and the interior of the toilet main body 2, and an guiding path 130*b* communicating with the hole 130*a* and guiding the water supply pipe 16 and electrical cable 18, which are the tubular members, into the hole 130*a*.

Also, a hole portion 130 is formed in a curved shape as seen in plan view, from the hole portion 130, along the hole 130*a*.

In a flush toilet apparatus 100 according to the above-described second embodiment, because the length in the width direction (the same direction as the longitudinal direction of the affixing member 14) or the depth direction (the same direction as the longitudinal direction of the affixing member 14) is shortened by the covering of at least a portion of the hole 130*a* of the hole portion 130 by the affixing member 14, the size of the toilet main body 2, and the size of the entire flush toilet apparatus 1, can be further reduced compared to the case when a portion of the hole portion 130 is not concealed by the affixing member 14.

Also, the hole portion 130 has a hole 130*a* penetrating the entire wall thickness of the toilet main body 2, and an guiding path 130*b* disposed adjacent to this hole 130*a* and guiding the water supply pipe 16 and electrical cable 18 to the hole, whereby the insertion of the water supply pipe 16 and the electrical cable 18 into the hole 130*a* through the gap formed between the affixing member 14 and the guiding path 130*b* means that not only does the guiding path 130*b* serve as a guide when inserting the water supply pipe 16 and electrical cable 18 into the hole 130*a*, but also that the water supply pipe 16 and electrical cable 18 can be inserted from the guiding path 130*b* into the hole 130*a* even if at least a portion of the hole portion 130 is covered by the affixing member 14.

Therefore even in a compact flush toilet apparatus, such as one in which the affixing member 14 and a portion of the hole 130*a* overlap, the water supply pipe 16 and electrical cable 18 can be easily inserted into the toilet main body 2 when the washing apparatus 4 is being installed on or removed from the toilet main body 2.

Additionally, because the guiding path 130*b* of the hole portion 130 is positioned further to the inside than the end portion in the longitudinal direction of the affixing member 14, the length in the width direction of the toilet main body 2 (the same direction as the longitudinal direction of the affixing member 14) is shorter compared to the case when the guiding path 130*b* of the hole portion 130 is further outside the end portion in the longitudinal direction of the affixing member 14, therefore the size of the toilet main body 2 can be reduced, and the size of the entire flush toilet apparatus 100 can be reduced.

For both the base end portions 16*a*, 18*a* of the water supply pipe 16 and electrical cable 18, and the hole portion 130 of the toilet main body 2, the exposed length of the water supply pipe 16 and the electrical cable 18 is shortened by the placement of these items on one side or the other in the width direction of the toilet main body 2 relative to the left-right direction center axis line C extending in the front-back direction of the flush toilet apparatus 1, therefore exposure of the water supply pipe 16 and electrical cable 18 can be constrained.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet apparatus comprising:

a flush toilet main body;

an affixing member affixed on a rear top surface of the flush toilet main body; and a washing apparatus attached to the affixing member, the washing apparatus having at least one tubular member including a proximal end portion and a distal end portion, wherein the flush toilet main body includes an attaching hole and a hole portion which are formed on the rear top surface of the flush toilet main body, the attaching hole being configured to attach the affixing member to the flush toilet main body, wherein the proximal end portion of the at least one tubular member is connected to the washing apparatus and the distal end portion of the at least one tubular member is connected to a connecting portion disposed on the outside of the flush toilet apparatus via the hole portion, and the hole portion comprises a hole penetrating the entire wall thickness of the flush toilet main body, and a guiding path disposed adjacent to the hole, wherein only a part of the hole portion is covered by the affixing member, and wherein the at least one tubular member is disposed into the hole through a gap formed between the affixing member and the guiding path.

2. The flush toilet apparatus according to claim 1, wherein the guiding path of the hole portion is disposed further inside longitudinal end portions of the affixing member.

3. The flush toilet apparatus according to claim 1, wherein the proximal end portion of the at least one tubular member is disposed adjacent to one longitudinal end portion of the affixing member, and the hole of the hole portion is disposed adjacent to the other longitudinal end portion of the affixing member.

4. The flush toilet apparatus according to claim 1, wherein the proximal end portion of the at least one tubular member and the hole portion of the flush toilet main body are disposed on the same side with respect to the longitudinal central cross-section of the flush toilet main body.

5. The flush toilet apparatus according to claim 1, wherein the at least one tubular member is either a water supply pipe, or an electrical cable.

6. The flush toilet apparatus according to claim 1, wherein the washing apparatus is removably secured on the flush toilet main body by slide operation of the washing apparatus in the front-back direction, the hole portion is disposed on the rear side of the top surface of the flush toilet main body, and wherein the proximal end portion of the at least one tubular member is disposed on one side with respect to the longitudinal central cross-section of the flush toilet main body, and the hole portion is disposed on the other side with respect to the longitudinal central cross-section of the flush toilet main body.

7. The flush toilet apparatus according to claim 6, wherein the guiding path of the hole portion is disposed backward of the affixing member in the front-back direction of the flush toilet apparatus.

8. The flush toilet apparatus according to claim 6, wherein the at least one tubular member proximal end portion and hole portion are disposed adjacent to the respective end portions of the affixing member.

9. The flush toilet apparatus according to claim 6, wherein the at least one tubular member is a water supply pipe.

10. The flush toilet apparatus according to claim 6, wherein the least one tubular member comprises a plurality of tubular members, the tubular members being a water supply pipe, and an electrical cable.

11. The flush toilet apparatus according to claim 6, wherein the guiding path of the hole portion has an indentation a bottom of which is downward sloped toward the hole.

* * * * *